US008847937B2

(12) United States Patent
Lee et al.

(10) Patent No.: US 8,847,937 B2
(45) Date of Patent: Sep. 30, 2014

(54) LIQUID CRYSTAL DISPLAY DEVICE SELECTING AN INVERSION-DRIVING SYSTEM BASED ON PRIORITY ORDER OF SMEAR AND SHUT-DOWN PATTERNS AND DRIVING METHOD THEREOF

(75) Inventors: Sang Hoon Lee, Daegu (KR); Beon Young Kim, Gyeongbuk (KR)

(73) Assignee: LG Display Co., Ltd., Seoul (KR)

( * ) Notice: Subject to any disclaimer, the term of this patent is extended or adjusted under 35 U.S.C. 154(b) by 685 days.

(21) Appl. No.: 12/629,429

(22) Filed: Dec. 2, 2009

(65) Prior Publication Data

US 2010/0207918 A1 Aug. 19, 2010

(30) Foreign Application Priority Data

Feb. 18, 2009 (KR) ..... 10-2009-0013362

(51) Int. Cl.
*G09G 3/36* (2006.01)

(52) U.S. Cl.
CPC ..... *G09G 3/3614* (2013.01); *G09G 3/3648* (2013.01)
USPC ..... 345/209; 345/96

(58) Field of Classification Search
None
See application file for complete search history.

(56) References Cited

U.S. PATENT DOCUMENTS

| | | | | |
|---|---|---|---|---|
| 6,680,722 | B1 | 1/2004 | Hiraki et al. | |
| 6,734,840 | B2 * | 5/2004 | Fukutoku et al. | 345/96 |
| 2004/0070581 | A1 * | 4/2004 | Hiraki et al. | 345/209 |
| 2009/0122054 | A1 * | 5/2009 | Lee et al. | 345/214 |
| 2010/0149151 | A1 * | 6/2010 | Nam et al. | 345/211 |

FOREIGN PATENT DOCUMENTS

| | | | |
|---|---|---|---|
| KR | 10-2000-0029282 | A | 5/2000 |
| KR | 10-2008-0109989 | A | 12/2008 |

OTHER PUBLICATIONS

Notice of Allowance issued by the Korean Intellectual Property Office on Sep. 3, 2013, in Korean Patent Application No. 10-2009-0013362.

* cited by examiner

*Primary Examiner* — Daniell L Negron
*Assistant Examiner* — Mark Fischer
(74) *Attorney, Agent, or Firm* — Morgan, Lewis & Bockius LLP

(57) ABSTRACT

An LCD device and a driving method thereof are disclosed. The LCD device and the driving method thereof accurately recognize an input pattern and perform the operation of any one of several inversion systems corresponding to the recognized pattern. Also, the LCD device and the driving method thereof detects the priority order of at least two different patterns and perform the operation of an optimized inversion system, even though at least two different patterns may be input.

20 Claims, 3 Drawing Sheets

LIQUID CRYSTAL DISPLAY DEVICE SELECTING AN INVERSION-DRIVING SYSTEM BASED ON PRIORITY ORDER OF SMEAR AND SHUT-DOWN PATTERNS AND DRIVING METHOD THEREOF

CROSS-REFERENCE TO RELATED APPLICATION

This application claims priority under 35 U.S.C. 119 to Korean Patent Application No. 10-2009-0013362, filed on Feb. 18, 2009 which is hereby incorporated by reference in its entirety.

BACKGROUND

1. Field of the Disclosure

This disclosure relates to a liquid crystal display (LCD) device, and more particularly to an LCD device adapted to analyze a pattern capable of causing a picture distortion and to operate (or be driven) in an inversion driving system corresponding to the analyzed resultant, and a driving method thereof.

2. Description of the Related Art

Generally, an LCD device controls the light transmissivity of a liquid crystal using an electric field and thus displays an image. The LCD device includes a liquid crystal panel, on which liquid crystal cells are arranged in a matrix shape, and a drive circuitry driving the liquid crystal panel.

On the liquid crystal panel, gate lines and data lines cross each other and thin film transistors TFT driving respective liquid crystal cells Clc are formed at the intersections of these gate and data lines. The thin film transistor TFT is responds to a scan signal applied through the gate line and in turn supplies a pixel electrode of the liquid crystal cell Clc with a data voltage applied through the data line. To this end, the thin film transistor TFT includes a gate electrode connected to the gate line, a source electrode connected to the data line, and a drain electrode connected to the pixel electrode of the liquid crystal cell Clc. A storage capacitor Cst is connected to the liquid crystal cell Clc. The liquid crystal cell Clc charges a different voltage (or an electric potential difference) between the data voltage applied to the data line and a common voltage applied to a common electrode. The different voltage (or the electric potential different) generates an electric field causing the liquid crystal molecular alignment to change, so that the amount of transmitted light is controlled or light is blocked.

The LCD device is driven in an inversion system inverting the polarity of the data voltage to be charged in the liquid crystal cell Clc, in order to reduce flickers and residual images. The inversion system includes a line inversion system and a dot inversion system. The line inversion system enables the data voltages applied to the vertically adjacent liquid crystal cells to have polarities inverted from each other. The dot inversion system forces the data voltages applied to both the horizontally and vertically adjacent liquid crystal cells to have polarities inverted from each other. The dot inversion system is mainly used in the LCD devices because flickers in both of the horizontal and vertical directions hardly ever develop in such a system.

The dot inversion system forces the data voltages applied to the adjacent liquid crystal cells in the horizontal direction to have polarities inverted from each other, as well as the voltages applied to the adjacent liquid crystal cells in the vertical direction to have polarities inverted from each other. The dot inversion system is mainly used in the LCD devices because it can minimize flickers in both horizontal and vertical directions.

A two-dot inversion system inverts the polarity of the data signal every two dots in both horizontal and vertical directions. This two-dot inversion system has lower electric power consumption than the one-dot inversion system.

Meanwhile, the LCD device often receives a specific pattern, which causes a picture-distorting phenomenon, such as a smear pattern or a shut-down pattern. To address this, the LCD device includes a smear pattern recognizer and a shut-down pattern recognizer separately provided in the timing controller which controls the drive circuit. Each of the smear and shut-down pattern recognizers identifies the respective pattern and selects an inversion-driving system capable of reducing the picture-distorting phenomenon which can be caused by the respective pattern. Accordingly, the LCD device can be driven in any one inversion-driving system selected by the smear pattern recognizer or the shut-down pattern recognizer.

Such an LCD device includes a smear pattern recognizer and a shut-down recognizer, but is not configured to simultaneously recognize the smear pattern and the shut-down pattern. Actually, when the smear pattern and the shut-down pattern are simultaneously applied to the LCD device (i.e., an image data including the smear pattern and the shut-down pattern is input to the LCD device), the smear pattern recognizer and the shut-down pattern recognizer both fail to recognize the respective patterns and don't select any inversion-driving system capable of preventing the picture-distorting phenomena which are caused by the respective patterns. As a result, the picture-distorting phenomenon occurs in the LCD device.

BRIEF SUMMARY

Accordingly, the present embodiments are directed to an LCD device that substantially obviates one or more of problems due to the limitations and disadvantages of the related art, and to a driving method thereof.

An object of the present embodiment is to provide an LCD device that analyzes and recognizes simultaneously input specific patterns different from one another according to a desired condition of being initially established and accurately selects inversion-driving systems corresponding to the simultaneously input specific patterns, and a driving method thereof.

Another object of the present embodiment is to provide an LCD device that prevents picture distortions capable of being caused by specific patterns so as to improve picture quality, and a driving method thereof.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to one general aspect of the present embodiment, an LCD device includes: an input unit configured to input data; a liquid crystal panel configured to include a plurality of gate lines and a plurality of data lines arranged on it and to display an image corresponding to the data; a pattern recognizer configured to recognize at least one of a smear pattern and a shut-down pattern as specific patterns capable of causing picture-distorting phenomena and to generate a selection signal, which enables any one of several inversion systems capable of reducing the picture-distorting phenomena to be selected, on the basis of the recognized resultant; and an inversion driver configured to select an inversion system in correspondence with the selection signal and to drive a data driver and the liquid crystal panel in the selected inversion system, wherein the pattern recognizer detects a priority order of the smear and shut-down patterns and enables any one of the inversion systems to be selected according to the priority order when the data including all the smear and shut-down patterns is input.

A driving method of an LCD device according to another aspect of the present embodiment is applied to an LCD device including an input unit configured to input a data and a liquid crystal panel configured to display an image corresponding to the data, The method includes: determining whether or not the input data includes at least one of a smear pattern and a shut-down pattern as specific patterns capable of causing picture-distorting phenomena; examining whether or not the input data satisfies a primary smear pattern recognition condition when the smear pattern is superior to the shut-down pattern; checking whether the input data satisfies a primary shut-down pattern recognition condition when the input data satisfies the primary smear pattern recognition condition; driving the liquid crystal panel in any one system of several inversion systems in correspondence with the matching resultant of the input data and the shut-down pattern recognition condition; and a displaying the image corresponding to the input data on the liquid crystal panel, wherein the liquid crystal panel is driven in a horizontal 2-dot inversion system when the input data does not satisfy the primary smear pattern recognition condition.

A driving method of an LCD device according to still another aspect of the present embodiment is applied to an LCD device including an input unit configured to input a data and a liquid crystal panel configured to display an image corresponding to the data. The method includes: determining whether or not the input data includes at least one of a smear pattern and a shut-down pattern as specific patterns capable of causing picture-distorting phenomena; examining whether or not the input data satisfies a primary shut-down pattern recognition condition when the shut-down pattern is superior to the smear pattern; checking whether the input data satisfies a primary smear pattern recognition condition when the input data satisfies the primary shut-down pattern recognition condition; driving the liquid crystal panel in any one system of several inversion systems in correspondence with the matching resultant of the input data and the smear pattern recognition condition; and a displaying the image corresponding to the input data on the liquid crystal panel, wherein the liquid crystal panel is driven in a horizontal 2-dot inversion system when the input data does not satisfy the primary shut-down pattern recognition condition.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings.

DETAILED DESCRIPTION

Figure 1:
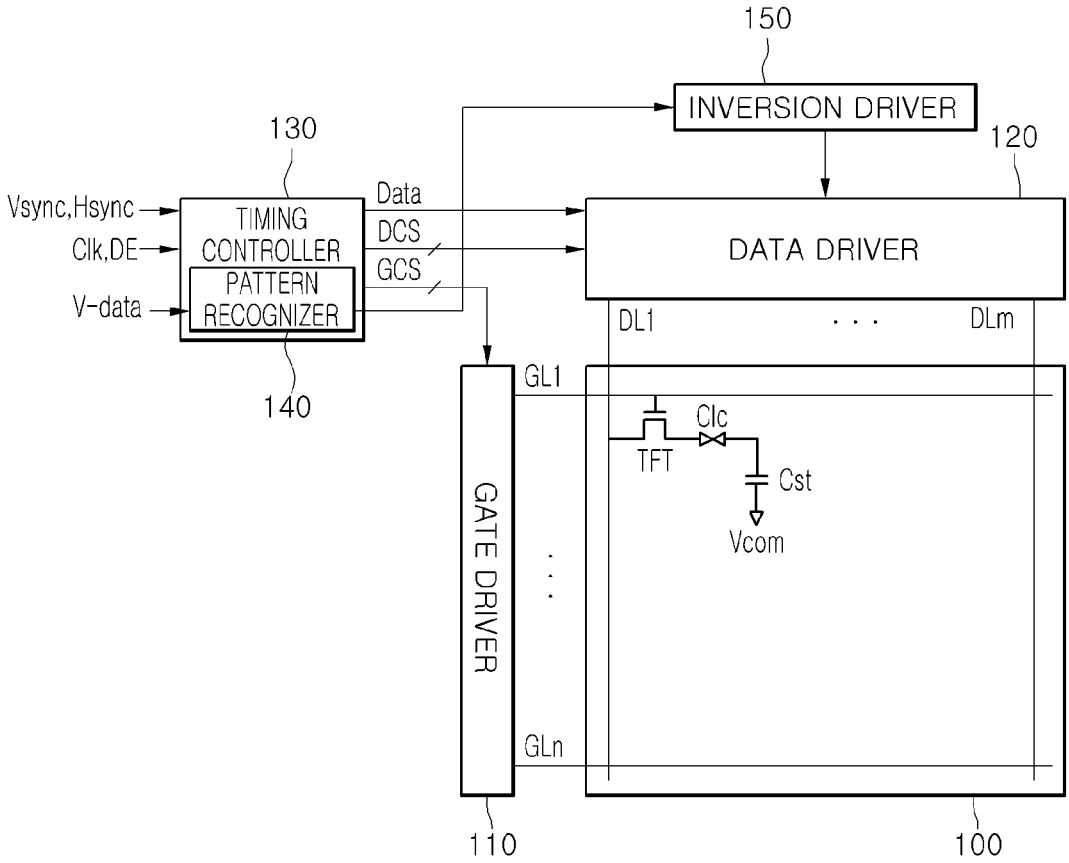
FIG. 1 is a view showing an LCD device according to an embodiment of the present disclosure.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

FIG. 1 is a view showing an LCD device according to an embodiment of the present disclosure. As shown in FIG. 1, an LCD device according to an embodiment of the present disclosure includes: a liquid crystal panel 100 configured to display an image and to include a plurality of gate lines GL1~GLn and a plurality of data lines DL1~DLm arranged on it; a gate driver 110 configured to apply scan signals to the plurality of the gate lines GL1~GLm; a data driver 120 configured to apply data signals to the plurality of the data lines DL1~DLm; a timing controller 130 configured to control the drive the timing of the gate and data drivers 110 and 120; and an inversion driver 150 configured to analyze whether at least one of the specific patterns which causes a picture distorting phenomenon is included in a frame data V-data from an external video source, and to drive the liquid crystal panel 100 in any one of several inversion systems corresponding to the analyzed resultant.

The liquid crystal panel 100 includes pixels each formed in regions which are defined by the plurality of gate lines GL1~GLn and the plurality of the data lines DL1~DLm. Each of the pixels includes a thin film transistor TFT formed an intersection of the respective gate and data lines GL and DL and a liquid crystal cell Clc connected between the thin film transistor TFT and a common electrode Vcom. The thin film transistor TFT responds to the scan signal on the respective gate line GL and switches the pixel data voltage to be applied from the respective data line DL to the respective liquid crystal cell Clc.

In order to drive the liquid crystal cells on the liquid crystal panel 100, several inversion systems including a frame inversion system, a line inversion system, a column inversion system, and a dot inversion system may be used. The frame inversion system inverts the polarities of the data signals applied the liquid crystal cells Clc on the liquid crystal panel 100 whenever the frame changes (i.e., every one frame). The line (or row) inversion system inverts the polarities of the data signals applied to the liquid crystal cells Clc every one line (one gate line) of the liquid crystal panel 100. The column inversion system inverts the polarities of the data signals applied to the liquid crystal cells Clc every one column (i.e., one data line) of the liquid crystal panel 100. The dot inversion system enables the polarities of the data signals applied to any one liquid crystal cell Clc and the vertically and horizontally adjacent liquid crystal cells on the liquid crystal panel 100 to be contrary to each other. Also, the dot inversion system inverts the polarities of the data signals applied to the liquid crystal cells Clc on the liquid crystal panel 100.

Recently, electric appliances such as notebook computers, in order to consume a low level of electric power, have been formulated to use a low frame frequency. In order to prevent the deterioration of picture-quality due to this lowered frame frequency, several inversion systems have been proposed, including a horizontal 2-dot inversion system, a horizontal 4-dot inversion system, and a square inversion system, which are derived from the dot inversion system and provide a superior picture-quality.

The horizontal 2-dot inversion system enables the polarity of the data signal to be inverted every one dot in the vertical direction and every two dots in the horizontal direction. This horizontal 2-dot inversion system inverts the polarities of the data signals applied to all the liquid crystal cells Clc on the liquid crystal panel 100 every frame. Also, the horizontal 4-dot inversion system enables the polarity of the data signal to be inverted every one dot in the vertical direction and every four dots in the horizontal direction. Similarly to the horizontal 2-dot inversion system, the horizontal 4-dot inversion system inverts the polarities of the data signals applied to all the liquid crystal cells Clc on the liquid crystal panel 100 every frame. Furthermore, the square inversion system enables the polarity of the data signal to be inverted every two dots in both vertical and horizontal directions. The square inversion system also inverts the polarities of the data signals applied to all the liquid crystal cells Clc on the liquid crystal panel 100 every frame.

The gate driver 110 responds to gate control signals GCS from the timing controller 130 and applies the plurality of scan signals to the plurality of gate lines GL1~GLn, respectively. The plurality of scan signals force the plurality of gate lines GL1~GLn to be sequentially enabled in one horizontal synchronous signal period.

The data driver 120 responds to data control signals DCS from the timing controller 130. Whenever any one of the plurality of gate lines GL1~GLn is enabled, the data driver 120 generates the plurality of data signals and applies the plurality of data signals to the plurality of data lines DL1~DLm on the liquid crystal panel 100. To this end, the data driver 120 receives one line of pixel data from the timing controller 130 and converts this single line of pixel data into pixel data voltages of an analog signal shape using a set of gamma voltages.

The inversion driver 150 analyzes whether an image data V-data input from an external video source (in an external system) includes any one of the specific patterns causing a picture distortion phenomenon. The inversion driver 150 selects any one among several inversion systems according to the analyzed resultant and drives the data driver 120 and the liquid crystal panel 100 in the selected inversion system. More specifically, the timing controller 130 receives the image data V-data from the external video source and analyzes the image data V-data, in order to apply the analyzed resultant to the inversion driver 150. Accordingly, the inversion driver 150 selects any one inversion system designated by the analyzed resultant signal from the timing controller 130.

The timing controller 130 derives the gate control signals GCS and the data control signals DCS from synchronous signals Vsync and Hsync, a data enable signal DE, and a clock signal CLK which are applied from the external video source (for example, the graphic module of a computer system or the image demodulation module of a television receiver (not shown)). The gate control signals GCS are used for controlling the gate driver 110, and the data control signals DCS are used for controlling the data driver 120. Also, the timing controller 130 rearranges the data applied from the external video source and supplies the rearranged data to the data driver 120.

Furthermore, the timing controller 130 is configured to include a pattern recognizer 140. The pattern recognizer 140 pattern-analyzes the image data V-data input from the external video source and recognizes whether the image data V-data does or does not include at least one of the specific patterns, which can cause a picture distorting phenomenon, including a smear pattern, a shut-down pattern and other patterns. The pattern recognizer 140 forces the inversion driver 150 to select an inversion system corresponding to the recognized pattern.

When the smear pattern and/or the shut-down pattern are included in the image data V-data from the external video source, this may very possibly cause a picture-distorting phenomenon on the liquid crystal panel 100. To address this, the pattern recognizer 140 analyzes and recognizes the specific patterns, which are included in the image data V-data, such as the smear and shut-down pattern causing the picture-distorting phenomenon. On the basis of the recognized resultant, the pattern recognizer 140 generates a selection signal which forces the inversion driver 150 to select an inversion system capable of minimizing the picture-distorting phenomenon.

If the pattern recognizer 140 recognizes the smear pattern in (or from) image data V-data which is input from the external video source, the inversion driver 150 drives the liquid crystal panel 100 and the data driver 120 in the horizontal 4-dot inversion system. Accordingly, the picture-distorting phenomenon which can be caused by the smear pattern is reduced.

Also, if the pattern recognizer 140 recognizes the shut-down pattern in (or from) the image data V-data which is input from the external video source, the inversion driver 150 drives the liquid crystal panel 100 and the data driver 120 in the square inversion system. As such, the picture-distorting phenomenon which can be caused by the shut-down pattern is reduced.

On the contrary to the above cases, when the pattern recognizer 140 doesn't recognize any one of the specific patterns in (or from) the image data V-data which is input from the external video source, the inversion driver 150 drives the liquid crystal panel 100 and the data driver 120 in the horizontal 2-dot inversion system.

Figure 2:
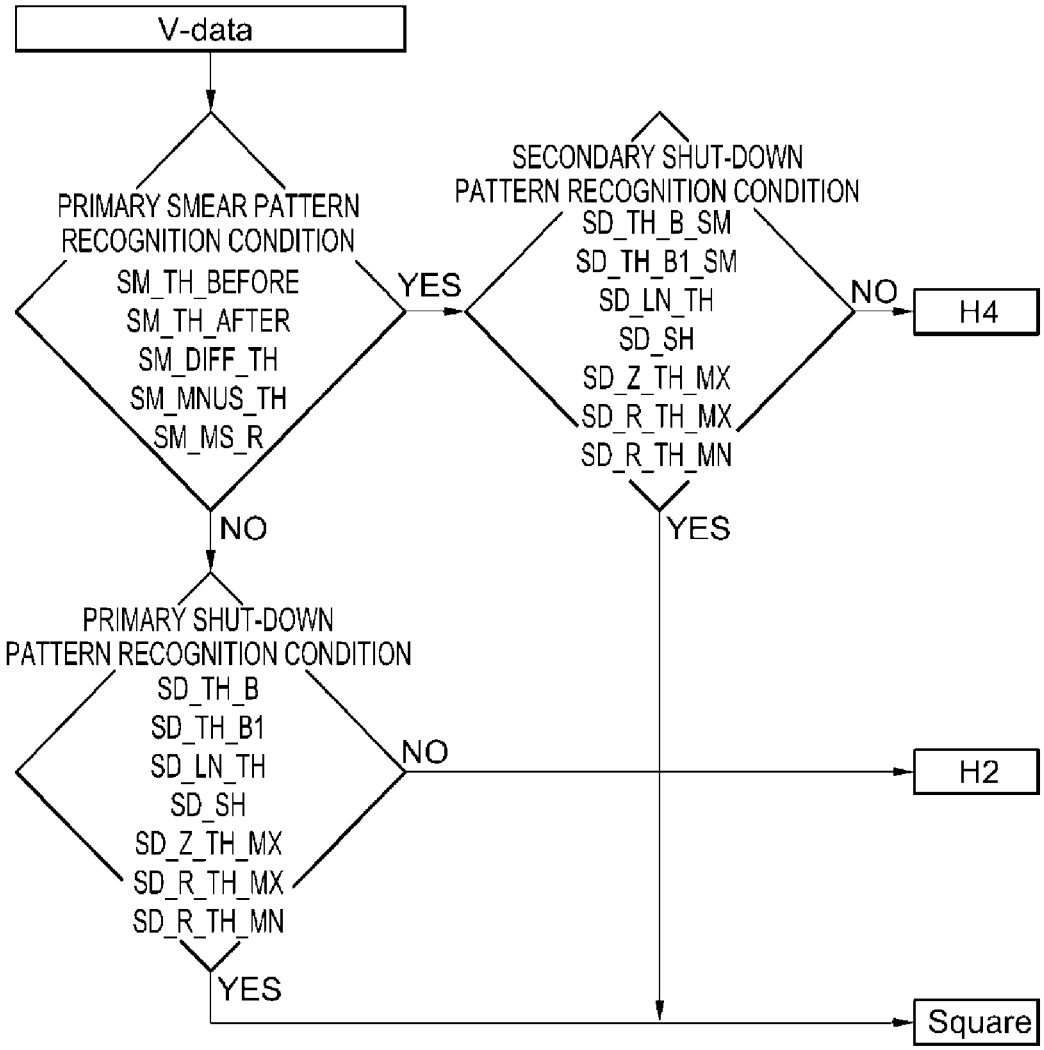
FIG. 2 is a view explaining an operation algorithm according to an embodiment of the pattern recognizer of FIG. 1.

FIG. 2 is a view explaining an operation algorithm according to an embodiment of the pattern recognizer of FIG. 1. As shown in FIGS. 1 and 2, the pattern recognizer 140 determines whether or not specific patterns, such as a smear pattern, a shut-down pattern, and others, causing picture-distorting phenomena are included in an image data V-data, when the image data V-data is input.

More specifically, the pattern recognizer 140 may be set up to primarily recognize the image data V-data as the smear pattern when the image data V-data from the external video source includes smear pattern components (or factors) of over 5.2%. After recognizing the image data V-data as the smear pattern, the pattern recognizer 140 may be set up to identify that the image data V-data does not include the smear pattern when the smear pattern components (or factors) in the image data V-data is lowered below 4.6%.

Also, the pattern recognizer 140 may be programmed to primarily recognize the image data V-data as the shut-down pattern if the image data V-data includes shut-down pattern components (or factor) of over 90% among an entire image data V-data. The pattern recognizer 140 may be programmed to primarily recognize when lines containing only the shut-down components are included in the image data V-data, too. Such primary smear and shut-down pattern recognition conditions previously programmed in the pattern recognizer 140 can be changed according to the specifications of the LCD device.

When the image data V-data including all of the smear and shut-down patterns is input, the pattern recognizer 140 determines whether the image data V-data satisfies the primary setting conditions. If the smear pattern components in the image data are superior in numbers to the shut-down pattern components, the pattern recognizer 140 preferentially determines whether or not the image data V-data satisfies the primary smear pattern recognition condition. The primary smear pattern recognition condition is as follows:

1. "SM_TH_BEFORE: 106"~A setting requisite of a smear pattern recognition ON-region (For example, an image data is recognized as the smear pattern when it includes smear pattern components of over 5.4%.);
2. "SM_TH_AFTER: 94"~A resetting requisite of a smear pattern recognition OFF-region (For example, after the image data is recognized as the smear pattern, the image data is no longer recognized as the smear pattern when the smear pattern components included in the image data are lowered below 4.6%);
3. "SM_DIFF_TH: 200"~A brightness difference requisite between an ON-pixel and an OFF-pixel (For example, the smear pattern component is increased by "1" when the ON-pixel data has a higher gray-scale value by at least 200 than that of the OFF-pixel data);
4. "SM_MNUS_TH: 5"~A continuity requisite of the smear pattern (For example, the number of smear pattern components is down-counted by "1" when the smear pattern component is not detected continuously at least 5); and
5. "SM_MS_R: 0"~A recognition range requisite of the same gray (For example, all of the ON-pixel data have the same gray value.)

The primary smear pattern recognition condition described above may be applied to an LCD device with a high definition of 1366×768. The pattern recognizer 140 determines whether or not the image data V-data satisfies the primary smear pattern recognition condition described above, when the smear pattern components are superior in numbers to the shut-down pattern components.

If the image data V-data input from the external video source does not satisfy the primary smear pattern recognition condition, the pattern recognizer 140 determines whether or not the image data V-data includes the shut-down pattern. In other words, the pattern recognizer 140 checks whether or not the image data V-data meets the primary shut-down pattern recognition condition. The primary shut-down pattern recognition condition is as follows:

1. "SD_TH_B: 6"~A first recognition requisite of the shut-down pattern (For example, an image data is recognized as the shut-down pattern when it includes the shut-down pattern components of at least 90%.);
2. "SD_TH_B1: 1"~A second recognition requisite of the shut-down pattern (For example, after the image data is recognized as the shut-down pattern, the image data is no longer recognized as the shut-down pattern when the image data includes shut-down lines of at least 30% which are filled with only the shut-down pattern components.);
3. "SD_LN_TH: 682"~A length requisite of single line (For example, 682 pixels);
4. "SD_SH: 2"~A turning-ON/OFF requisite of the shut-down pattern recognizing function (For example, the shut-down pattern recognition function is turned-OFF when a quarter (i.e., 23%) of an ON-region is completed after the shut-down pattern recognition function is turned-ON.);
5. "SD_Z_TH_MX: 15"~A maximum brightness requisite of the OFF-pixel (For example, 15 gray-scale level);
6. "SD_R_TH_MA: 255"~A maximum brightness requisite of the ON-pixel (For example, 255 gray-scale level); and
7. "SD_R_TH_MIN: 32"~A minimum brightness requisite of the ON-pixel (For example, 32 gray-scale level).

The primary shut-down pattern recognition condition described above may be applied to an LCD device with a high definition of 1366×768. The pattern recognizer 140 determines whether or not the image data V-data satisfies the primary shut-down pattern recognition condition described above, when the smear pattern is not recognized.

If the image data V-data does not match with the primary shut-down pattern recognition condition, the pattern recognizer 140 identifies that the image data V-data does not include any one of the specific patterns which causes a picture distortion. In this case, the pattern recognizer 140 generates a selection signal allowing the horizontal 2-dot inversion system H2 to be selected. Accordingly, the inversion driver 150 responds to the selection signal and drives the liquid crystal panel 100 and the data driver 120 in the horizontal 2-dot inversion system H2.

On the contrary, when the image data V-data matches with the primary shut-down pattern recognition condition, the pattern recognizer 140 identifies that the image data V-data include the shut-down pattern which causes a picture-distortion. Then, the pattern recognizer 140 generates the selection signal allowing the square inversion system to be selected, in order to reduce the picture distortion caused by the shut-down pattern. Accordingly, the inversion driver 150 responds to the selection signal and drives the liquid crystal panel 100 and the data driver 120 in the square inversion system.

On the other hand, the pattern recognizer 140 determines that the image data V-data includes the smear pattern, when the image data input from the external video source satisfies the primary smear pattern recognition condition. The pattern recognizer 140 examines whether or not the image data V-data includes the shut-down pattern. In other words, the pattern recognizer 140 checks whether or not the image data V-data matches with a secondary shut-down pattern recognition condition. The secondary shut-down pattern recognition condition is as follows:

1. "SD_TH_B_SM: 18"~A first recognition requisite of the shut-down pattern (For example, an image data is recognized as the shut-down pattern when it includes shut-down pattern components of at least 59%);
2. "SD_TH_B1_SM: 9"~A second recognition requisite of the shut-down pattern (For example, after the image data is recognized as the shut-down pattern, the image data is no longer recognized as the shut-down pattern when the image data includes shut-down lines of at least 30% which are filled with only the shut-down pattern components);
3. "SD_LN_TH: 682"~A length requisite of single line (For example, 682 pixels);
4. "SD_SH: 2"~A turning-ON/OFF requisite of the shut-down pattern recognizing function (For example, the shut-down pattern recognition function is turned-OFF when a quarter (i.e., 23%) of an ON-region is completed after the shut-down pattern recognition function is turned-ON);

5. "SD_Z_TH_MX: 15"~A maximum brightness requisite of the OFF-pixel (For example, 15 gray-scale level);
6. "SD_R_TH_MA: 255"~A maximum brightness requisite of the ON-pixel (For example, 255 gray-scale level); and
7. "SD_R_TH_MIN: 32"~A minimum brightness requisite of the ON-pixel (For example, 32 gray-scale level).

The secondary shut-down pattern recognition condition described above may be applied to an LCD device with a high definition of 1366×768. The pattern recognizer 140 determines whether or not the image data V-data including the smear pattern satisfies the secondary shut-down pattern recognition condition described above.

If the image data V-data including the smear pattern does not match with the secondary shut-down pattern recognition condition, the pattern recognizer 140 identifies that the image data V-data includes only the smear pattern. In this case, the pattern recognizer 140 generates the selection signal allowing the horizontal 4-dot inversion system H4 to be selected, in order to reduce the picture distortion caused by the smear pattern. Accordingly, the inversion driver 150 is responsive to the selection signal and drives the liquid crystal panel 100 and the data driver 120 in the horizontal 4-dot inversion system H4.

Meanwhile, when the image data V-data including the smear pattern matches with the secondary shut-down pattern recognition condition, the pattern recognizer 140 identifies that the image data V-data includes the shut-down pattern which causes a picture-distortion. In this case, the pattern recognizer 140 generates the selection signal allowing the square inversion system SQUARE to be selected, in order to reduce the picture distorting phenomenon caused by the shut-down pattern. Accordingly, the inversion driver 150 responds to the selection signal and drives the liquid crystal panel 100 and the data driver 120 in the square inversion system SQUARE. The secondary shut-down pattern recognition condition may be set up (or established) differently from the primary shut-down pattern recognition condition.

In this manner, the pattern recognizer 140 recognizes whether or not the image data V-data input from the external video source includes the specific patterns, such as the smear pattern, the shut-down pattern, and others, which can cause the picture-distorting phenomena. When the smear pattern components are superior in number to the shut-down pattern components, the pattern recognizer 140 identifies whether or not the image data V-data matches the primary smear pattern recognition condition. If the image data V-data matches the primary smear pattern recognition condition, the pattern recognizer 140 examines whether or not the image data V-data includes the secondary shut-down pattern recognition condition. On the basis of the recognized resultants, the pattern recognizer 140 generates the selection signal and applies the selection signal to the inversion driver 150.

Consequently, although at least two specific patterns capable of causing picture-distorting phenomena are included in the image data V-data from the external video source, the LCD device according to an embodiment of the present disclosure detects the priority order of at least two specific patterns and is driven in an optimized inversion system. Therefore, the LCD device can prevent the picture-distorting phenomena. As a result, the picture quality of the LCD device can be improved.

Figure 3:
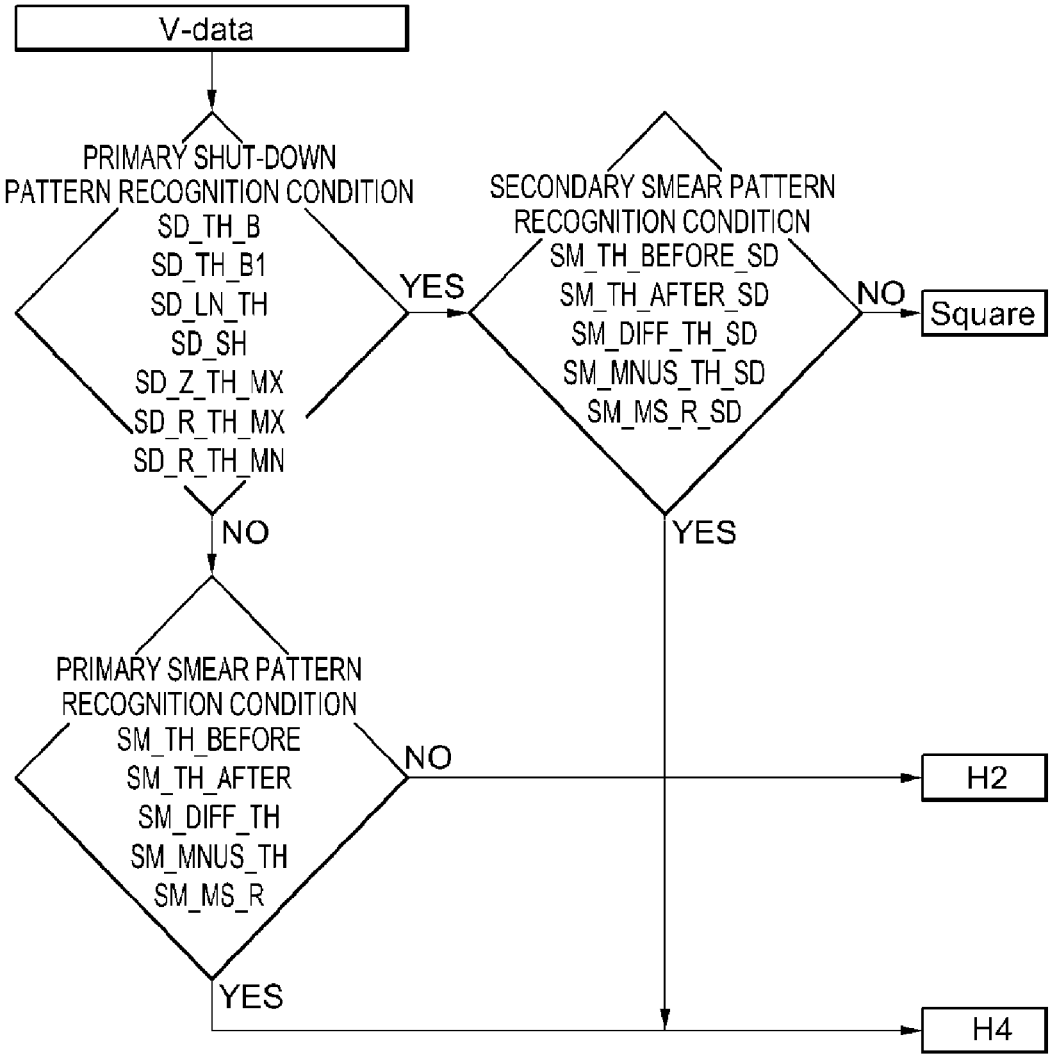
FIG. 3 is a view explaining another operation algorithm according to another embodiment of the pattern recognizer of FIG. 1.

FIG. 3 is a view explaining another operation algorithm according to another embodiment of the pattern recognizer of FIG. 1. Referring to FIGS. 1 and 3, the pattern recognizer 140 determines whether or not specific patterns, such as a smear pattern, a shut-down pattern, and others, which cause picture-distorting phenomena are included in an image data V-data, when the image data V-data is input.

When the image data V-data including all of the smear and shut-down patterns is input, the pattern recognizer 140 determines whether the image data V-data satisfies primary recognition conditions. If shut-down pattern components in the image data V-data are superior in numbers to smear pattern components, the pattern recognizer 140 preferentially determines whether or not the image data V-data satisfies a primary shut-down pattern recognition condition. The primary shut-down pattern recognition condition is the same as the one described in FIG. 2.

If the image data V-data input from the external video source does not satisfy the primary shut-down pattern recognition condition, the pattern recognizer 140 determines whether or not the image data V-data includes a smear pattern. In other words, the pattern recognizer 140 checks whether or not the image data V-data meets the primary smear pattern recognition condition. The primary smear pattern recognition condition may be the same as the one described in FIG. 2.

When the image data V-data does not match with the primary smear pattern recognition condition, the pattern recognizer 140 identifies that the image data V-data does not include any one of the specific patterns causing the picture distortion. In this case, the pattern recognizer 140 generates the selection signal allowing the horizontal 2-dot inversion system H2 to be selected. Accordingly, the inversion driver 150 responds to the selection signal and drives the liquid crystal panel 100 and the data driver 120 in the horizontal 2-dot inversion system H2.

On the contrary, when the image data V-data matches with the primary smear pattern recognition condition, the pattern recognizer 140 identifies that the image data V-data include the smear pattern causing the picture distortion. Then, the pattern recognizer 140 generates the selection signal allowing the horizontal 4-dot inversion system H4 to be selected, in order to reduce the picture distortion caused by the smear pattern. Accordingly, the inversion driver 150 responds to the selection signal and drives the liquid crystal panel 100 and the data driver 120 in the horizontal 4-dot inversion system H4.

On the other hand, the pattern recognizer 140 determines that the image data V-data includes the shut-down pattern when the image data input from the external video source satisfies the primary shut-down pattern recognition condition. The pattern recognizer 140 examines whether or not the image data V-data containing the shut-down pattern includes the smear pattern. In other words, the pattern recognizer 140 checks whether or not the image data V-data including the shut-down pattern matches with a secondary smear pattern recognition condition. The secondary smear pattern recognition condition is as follows:

1. "SM_TH_BEFORE: 106"~A setting requisite of a smear pattern recognition ON-region;
2. "SM_TH_AFTER: 94"~A resetting requisite of a smear pattern recognition OFF-region;
3. "SM_DIFF_TH: 200"~A brightness difference requisite between an ON-pixel and an OFF-pixel;
4. "SM_MNUS_TH: 5"~A continuity requisite of the smear pattern; and
5. "SM_MS_R: 0"~A recognition range requisite of the same gray.

If the image data V-data including the smear pattern does not match with the secondary smear pattern recognition condition, the pattern recognizer 140 identifies that the image data V-data includes only the shut-down pattern. In this case, the pattern recognizer 140 generates the selection signal allowing the square inversion system SQUARE to be selected, in order to reduce the picture distortion caused by the shut-down pattern. Accordingly, the inversion driver 150 responds to the selection signal and drives the liquid crystal panel 100 and the data driver 120 in the square inversion system SQUARE.

Meanwhile, when the image data V-data including the shut-down pattern matches with the secondary smear pattern recognition condition, the pattern recognizer 140 identifies that the image data V-data includes the smear pattern. In this case, the pattern recognizer 140 generates the selection signal allowing the horizontal 4-dot inversion system to be selected, in order to reduce the picture distorting phenomenon caused by the smear pattern. Accordingly, the inversion driver 150 responds to the selection signal and drives the liquid crystal panel 100 and the data driver 120 in the horizontal 4-dot inversion system. The secondary smear pattern recognition condition may be set up (or established) to have different values from the primary smear pattern recognition condition.

Furthermore, if the image data V-data input from the external video source does not match with the primary smear pattern recognition condition, the pattern recognizer 140 identifies that the image data V-data does not include any one of the specific patterns which cause a picture distortion. In this case, the pattern recognizer 140 generates the selection signal allowing the horizontal 2-dot inversion system to be selected. Accordingly, the inversion driver 150 responds to the selection signal and drives the liquid crystal panel 100 and the data driver 120 of FIG. 1 in the horizontal 2-dot inversion system.

In this manner, the pattern recognizer 140 recognizes whether or not the image data V-data input from the external video source includes the smear pattern and/or the shut-down pattern capable of causing the picture-distorting phenomena. When the shut-down pattern components are superior in number to the smear pattern components, the pattern recognizer 140 identifies whether or not the image data V-data matches the primary shut-down pattern recognition condition. If the image data V-data matches the primary shut-down pattern recognition condition, the pattern recognizer 140 examines whether or not the image data V-data includes the secondary smear pattern recognition condition. On the basis of the recognized resultants, the pattern recognizer 140 generates the selection signal and applies the selection signal to the inversion driver 150.

As described above, the LCD device according to an embodiment of the present disclosure detects the priority order of at least two specific patterns and is driven in an optimized inversion system, even though at least two specific patterns capable of causing the picture-distorting phenomena are included in the image data V-data from the external video source. Therefore, the LCD device can prevent the picture-distorting phenomena. As a result, the picture quality of the LCD device can be improved.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents.

What is claimed is:

1. A liquid crystal display device, comprising:

an input unit configured to input data;

a liquid crystal panel configured to:

include a plurality of gate lines and a plurality of data lines; and display an image corresponding to the data;

a pattern recognizer configured to:

recognize at least one of a smear pattern and a shut-down pattern as specific patterns capable of causing picture-distorting phenomena; and generate a selection signal, which enables any one of several inversion systems capable of reducing the picture-distorting phenomena to be selected, on the basis of the recognized resultant; and an inversion driver configured to:

select an inversion system in correspondence with the selection signal; and drive a data driver and the liquid crystal panel in the selected inversion system, wherein the pattern recognizer is further configured to:

determine whether or not the data matches with a primary smear pattern recognition condition, determine whether or not the data matches with a primary shut down pattern recognition condition, if the data does not satisfy the primary smear pattern recognition condition, determine whether or not the data matches with a secondary shut-down pattern recognition condition, if the data satisfies the primary smear pattern recognition condition, and enable any one of the inversion systems to be selected according to a determined resultant, wherein the primary shut down pattern recognition condition is established to have different values from the secondary shut-down pattern recognition condition, and wherein each of the primary smear pattern recognition condition, the primary shut-down pattern recognition condition, and the secondary shut-down pattern recognition condition has respective numerical values.

2. The device of claim 1, wherein the pattern recognizer is included in a timing controller.

3. The device of claim 1, wherein the pattern recognizer is further configured to:

determine whether or not the data matches with the primary smear pattern recognition condition;

determine whether or not the data matches with the primary shut-down pattern recognition condition, if the data does not satisfy the primary smear pattern recognition condition; and determine whether or not the data matches with the secondary shut-down pattern recognition condition, if the data satisfies the primary smear pattern recognition condition.

4. The device of claim 1, wherein the pattern recognizer conditionally determines the data matching with the primary smear pattern recognition condition, the primary shut-down pattern recognition condition, and the secondary shut-down pattern recognition condition.

5. A method of a liquid crystal display device including an input unit configured to input a data and a liquid crystal panel configured to display an image corresponding to the data, the method comprising:

examining whether or not the data satisfies a primary smear pattern recognition condition;

checking whether the data satisfies a primary shut-down pattern recognition condition if the data does not satisfy the primary smear pattern recognition condition;

driving the liquid crystal panel in any one system of several inversion systems in correspondence with a matching resultant of the data and the primary shut-down pattern recognition condition;

driving the liquid crystal panel in any one system of several inversion systems in correspondence with a matching resultant of the data and a secondary shut-down pattern recognition condition if the data satisfies the primary smear pattern recognition condition; and displaying the image corresponding to the data on the liquid crystal panel, wherein the primary shut down pattern recognition condition is established to have different values from the secondary shut-down pattern recognition condition.

6. The method of claim 5, wherein the liquid crystal panel is driven in a square inversion system if the data satisfies the primary smear pattern recognition condition and the secondary shut-down pattern recognition condition.

7. The method of claim 5, wherein the liquid crystal panel is driven in a horizontal 4-dot inversion system if the data satisfies the primary smear pattern recognition condition and does not satisfy the secondary shut-down pattern recognition condition.

8. The method of claim 5, wherein the liquid crystal panel is driven in a square inversion system if the data does not satisfy the primary smear pattern recognition condition and satisfies the primary shut-down pattern recognition condition.

9. The method of claim 5, wherein the liquid crystal panel is driven in a horizontal 2-dot inversion system if the data does not satisfy the primary smear pattern recognition condition and does not satisfy the primary shut-down pattern recognition condition.

10. The method of claim 5, wherein each of the primary smear pattern recognition condition, the primary shut-down pattern recognition condition, and the secondary shut-down pattern recognition condition has respective numerical values.

11. A method of a liquid crystal display device including an input unit configured to input a data and a liquid crystal panel configured to display an image corresponding to the data, the method comprising:

examining whether or not the data satisfies a primary shut-down pattern recognition condition;

checking whether the data satisfies a primary smear pattern recognition condition if the data does not satisfy the primary shut-down pattern recognition condition;

driving the liquid crystal panel in any one system of several inversion systems in correspondence with a matching resultant of the data and the primary smear pattern recognition condition;

driving the liquid crystal panel in any one system of several inversion systems in correspondence with a matching resultant of the data and a secondary smear pattern recognition condition if the data satisfies the primary shut-down pattern recognition condition; and displaying the image corresponding to the data on the liquid crystal panel, wherein the primary smear pattern recognition condition is established to have different values from the secondary smear pattern recognition condition, and wherein each of the primary shut-down pattern recognition condition, the primary smear pattern recognition condition, and the secondary smear pattern recognition condition has respective numerical values.

12. The method of claim 11, wherein the liquid crystal panel is driven in a horizontal 4-dot inversion system when the data satisfies the primary shut-down pattern recognition condition and the secondary smear pattern recognition condition.

13. The method of claim 11, wherein the liquid crystal panel is driven in a square inversion system when the data satisfies the primary shut-down pattern recognition condition and does not satisfy the secondary smear pattern recognition condition.

14. The method of claim 11, wherein the liquid crystal panel is driven in a horizontal 4-dot inversion system when the data does not satisfy the primary shut-down pattern recognition condition and satisfies the primary smear pattern recognition condition.

15. The method of claim 11, wherein the liquid crystal panel is driven in a horizontal 2-dot inversion system when the data does not satisfy the primary shut-down pattern recognition condition and does not satisfy the primary smear pattern recognition condition.

16. The method of claim 11, wherein driving the liquid crystal panel in any one system of several inversion systems conditionally determines the data matching with the primary shut-down pattern recognition condition, the primary smear pattern recognition condition, and the secondary smear pattern recognition condition.

17. A liquid crystal display device, comprising:

an input unit configured to input data;

a liquid crystal panel configured to:

include a plurality of gate lines and a plurality of data lines; and display an image corresponding to the data;

a pattern recognizer configured to:

recognize at least one of a smear pattern and a shut-down pattern as specific patterns capable of causing picture-distorting phenomena; and generate a selection signal, which enables any one of several inversion systems capable of reducing the picture-distorting phenomena to be selected, on the basis of the recognized resultant; and an inversion driver configured to:

select an inversion system in correspondence with the selection signal; and drive a data driver and the liquid crystal panel in the selected inversion system, wherein the pattern recognizer is further configured to:

determine whether or not the data matches with a primary shut-down pattern recognition condition, determine whether or not the data matches with a primary smear pattern recognition condition, if the data does not satisfy the primary shut-down pattern recognition condition, determine whether or not the data matches with a secondary smear pattern recognition condition, if the data satisfies the primary shut-down pattern recognition condition, and enable any one of the inversion systems to be selected according to a determined resultant, wherein the primary smear pattern recognition condition is established to have different values from the secondary smear pattern recognition condition.

18. The device of claim 17, wherein each of the primary shut-down pattern recognition condition, the primary smear pattern recognition condition, and the secondary smear pattern recognition condition has respective numerical values.

19. The device of claim 17, wherein the pattern recognizer is included in a timing controller.

20. The device of claim 17, wherein the liquid crystal panel is driven in a horizontal 4-dot inversion system if the data satisfies the primary shut-down pattern recognition condition and the secondary smear pattern recognition condition.

* * * * *